US008881492B2

(12) United States Patent
Piccirillo

(10) Patent No.: US 8,881,492 B2
(45) Date of Patent: Nov. 11, 2014

(54) WINDOW BUCK HAVING RIGHT TRAPEZOID CROSS-SECTION

(76) Inventor: Gary C. Piccirillo, Tequesta, FL (US)

( * ) Notice: Subject to any disclaimer, the term of this patent is extended or adjusted under 35 U.S.C. 154(b) by 0 days.

(21) Appl. No.: 13/408,329

(22) Filed: Feb. 29, 2012

(65) Prior Publication Data

US 2013/0219814 A1 Aug. 29, 2013

(51) Int. Cl.
*E06B 1/32* (2006.01)
*E05D 15/16* (2006.01)

(52) U.S. Cl.
USPC ..... 52/745.15; 52/656.5; 52/215

(58) Field of Classification Search
CPC ..... E06B 1/04; E06B 1/56; E06B 1/62; E06B 7/12; E06B 3/00; E04C 2/38
USPC ..... 52/215, 204.1, 204.5, 211, 208, 213, 52/656.5, 204.53, 126.1, 745.15
See application file for complete search history.

(56) References Cited

U.S. PATENT DOCUMENTS 1,544,760 A * 7/1925 Kiefer ..... 52/215
3,367,618 A * 2/1968 Masur ..... 249/39
5,347,780 A * 9/1994 Richards et al. ..... 52/204.1
5,437,130 A * 8/1995 Raynak ..... 52/210
6,018,916 A * 2/2000 Henry ..... 52/126.1
6,199,331 B1 * 3/2001 Hunt ..... 52/207
6,318,035 B1 * 11/2001 Jesse ..... 52/204.57
6,467,226 B2 * 10/2002 Dodson et al. ..... 52/220.1
6,755,231 B1 * 6/2004 Biggers ..... 160/183
7,669,382 B2 * 3/2010 Burton et al. ..... 52/745.16
8,104,241 B2 * 1/2012 Andres ..... 52/204.53
8,302,354 B2 * 11/2012 Quesada ..... 52/215
2007/0107330 A1 * 5/2007 Culverson ..... 52/204.5
2007/0204535 A1 * 9/2007 Hughes ..... 52/215
2009/0044466 A1 * 2/2009 Andres ..... 52/204.53
2009/0205272 A1 * 8/2009 Rosende ..... 52/215

FOREIGN PATENT DOCUMENTS

GB 2250530 A * 6/1992 ..... E04B 1/76

* cited by examiner

*Primary Examiner* — William Gilbert
*Assistant Examiner* — Beth Stephan
(74) *Attorney, Agent, or Firm* — Simpson & Simpson, PLLC

(57) ABSTRACT

A window buck/drywall panel assembly comprising a window buck having a cross-section where the cross-section defines a right trapezoid, where the window buck includes a window buck beveled edge; and a drywall panel having a cross-section where the cross-section defines a right trapezoid, where the drywall panel includes a drywall beveled edge, and the window buck and the drywall panel are secured to one another such that the window buck beveled edge and the drywall beveled edge are in contact with one another.

19 Claims, 7 Drawing Sheets

WINDOW BUCK HAVING RIGHT TRAPEZOID CROSS-SECTION

FIELD OF THE INVENTION

The invention broadly relates to window bucks, and, more particularly, to a window buck having a right trapezoid cross section.

BACKGROUND OF THE INVENTION

In the construction industry, it is a standard practice to provide "roughed in" openings within the basic structural framing of a building for the installation of pre-fabricated window assemblies. A common technique used to install window assemblies within the roughed opening is known as "bucking" the window. This includes installing pieces of material known as "window bucks" inside the window opening to compensate for the difference between the width of the window opening and the dimensions of the window assembly. For proper window installation, the window bucks need to be placed a predetermined distance (known as the "setback distance") from the outer edge of the window opening to provide uniform windowsills or "reveals." Additionally, the window bucks should be aligned substantially parallel to the window opening so that the window assembly can be installed squarely with respect to the window opening.

As mentioned above, window bucks are well known in the construction industry and provide a surface on which to fixedly secure a window frame assembly to the rough concrete block opening. Traditional window bucks have a rectangular cross-section and have a squared front surface such that the top surface and the bottom surface are substantially perpendicular to, and each intersect, the front surface at 90 degree angles. An example of a prior art squared window buck is shown in FIG. 1, which illustrates a perspective view of window frame/window buck/drywall panel assembly 10 having window bucks 12*a*, 12*b*, 12*c*, and 12*d*, and window assembly 11, which includes window frame 14 and window 15. Window opening surfaces 18*a*, 18*b*, 18*c*, and 18*d* are formed when a window opening is cut into wall 16. Wall 16 is typically made of concrete or cinder blocks. Each window buck 12*a*, 12*b*, 12*c*, and 12*d*, is fixedly secured to a corresponding window opening surface 18*a*, 18*b*, 18*c*, and 18*d*, respectively via concrete fasteners, such as screws, nails, or the like.

Once the window assembly is installed, there is usually a bare space between the window opening surface and the installed window frame. When the adjacent interior walls are completed, using drywall panels, plaster, or other material, this bare space often appears as an unsightly transition gap between the window opening surface and the completed wall. Typically, this space is filled with some form of drywall or other material to cover this area and provide a consistent surface between the finished interior wall and the window frame. The installation of such material is generally referred to as "wrapping" the window.

As shown in FIGS. 1 and 2, wood blocks 17*a*, 17*b* are fixedly secured to wall 16 near the window opening. Wood block 17*a* is secured vertically and substantially perpendicular to wood block 17*b*, which is secured horizontally to wall 16. Then, metal angles 19*a*, 19*b* are "wrapped" around corresponding wood blocks 17*a*, 17*b*, respectively, such that metal angles 19*a*, 19*b*, each form an L-shape. After that, drywall panels 13*a*, 13*b* are each fixedly secured, and substantially parallel, to corresponding metal angles 19*a*, 19*b*, respectively, such that drywall panels 13*a*, 13*b* are in contact with and substantially perpendicular to window frame 14. Subsequently, drywall panel 13*c* is fixedly secured to wood blocks 17*a*, 17*b* such that drywall panel 13*c* is substantially perpendicular to drywall panels 13*a*, 13*b*.

A problem with prior window bucks is that since the drywall panel is typically fixedly secured to the surface of the window buck adjacent to the window frame, and in contact with the window frame, a portion of the window frame is obscured, which is not aesthetically appealing. Another problem with prior window bucks is that it is necessary to secure the window buck to a metal angle, which then must be secured to a wood block. Since additional materials, such as metal angles, need to be used, construction costs are increased. Additionally, a large space is formed between the drywall panel and the window opening surface, possibly compromising the integrity of the construction.

Thus, there is a long-felt need for a window buck that can be fixedly secured closer to the window opening surface while allowing the drywall panel to be secured in such a manner that the entire window frame is exposed, and therefore, more aesthetically appealing. There is also a long-felt need for a window buck to which drywall panels can be secured such that the drywall panels are in closer proximity with the window opening surface, which strengthens the integrity of the construction. Furthermore, there is also a long-felt need for a window buck to which drywall panels can be secured directly without the need for an intermediary metal angle, and thus, reducing overall construction costs.

BRIEF SUMMARY OF THE INVENTION

The present invention broadly comprises a window buck having a cross-section where the cross-section defines a right trapezoid. In another embodiment, the present invention comprises a window buck/drywall panel assembly having a window buck and a drywall panel. The window buck has a cross-section where the cross-section defines a right trapezoid, and the window buck includes a window buck beveled edge. The drywall panel has a cross-section where the cross-section defines a right trapezoid and the drywall panel includes a drywall beveled edge. The window buck and the drywall panel are secured to one another such that the window buck beveled edge and the drywall beveled edge are in contact with one another.

The window buck comprises a top surface, a bottom surface, a first side surface, and a second side surface. The second side surface and the bottom surface of the window buck are arranged at an acute angle $\theta$ to one another. The drywall panel comprises a top surface, a bottom surface, a first side surface, and a second side surface. Similar to the window buck, the second side surface and the bottom surface of the drywall panel are arranged at an acute angle $\sigma$ to one another. Acute angle $\theta$ is in the range of approximately 30 degrees to 60 degrees, but preferably acute angle $\theta$ is approximately 45 degrees. Acute angle $\sigma$ is in the range of approximately 30 degrees to 60 degrees, but preferably angle $\sigma$ is approximately 45 degrees.

The bottom surface of the window buck further comprises a channel that is operatively arranged to receive caulking. Additionally, the window buck is operatively arranged to be securable about a concrete wall by any suitable means, such as screws, nails, adhesive, etc. Moreover, the window buck can be made of any suitable material such as composite material, polyvinyl chloride, wood, plastic, etc.

The present invention comprises a method of installing a window in an opening in a dwelling, where the window includes a frame, and the opening is bounded by concrete or cinder blocks. The method comprises the following steps. First, a window buck having a cross-section, where the cross-section defines a right trapezoid and where the window buck includes a window buck beveled edge, is secured to the concrete or cinder blocks bounding the opening. Next, the window frame is secured to the window buck. After that, a drywall panel having a cross-section, where the cross-section defines a right trapezoid and where the drywall panel includes a drywall beveled edge, is secured to the window buck such that the window buck beveled edge and the drywall beveled edge are in contact with one another.

In yet another embodiment, the present invention comprises a window frame/window buck assembly, having a window assembly and a window buck assembly. The window assembly includes a window frame having four sides. The window buck assembly includes four window bucks. Each window buck has a cross-section, where the cross-section defines a right trapezoid, where each of the sides of the window frame is secured on one of the window bucks.

In yet another embodiment, the present invention comprises a window frame/window buck/drywall panel assembly, having a window assembly, a window buck assembly, and a drywall panel assembly. The window assembly includes a window frame having four sides. The window buck assembly includes four window bucks. Each window buck has a cross-section and each window buck includes a window buck beveled edge, where the cross-section defines a right trapezoid, where each of the sides of the window frame is secured to one of the window bucks. The drywall panel assembly includes four drywall panels. Each drywall panel has a cross-section, where the cross-section defines a right trapezoid and where the drywall panel includes a drywall beveled edge. The drywall panel assembly is secured to the window buck assembly such that a window buck beveled edge of each window buck is in contact with a drywall beveled edge of each drywall panel.

It is a general object of the present invention to provide a window buck and a drywall panel, both with a beveled edge. The beveled edges allow the window buck and the drywall panel to matingly engage one another when cut at the same angle. Additionally, the beveled edges allow the drywall panels to be fixedly secured such that the entire window frame is exposed, and therefore, is more aesthetically appealing. It is another object of the invention to provide a window buck to which drywall panels can be secured such that drywall panels are in closer proximity with the window opening surface, which strengthens the integrity of the construction. It is yet another object of the invention to provide a window buck to which drywall panels can be secured directly without the need for an intermediary metal angle, and thus, reducing overall construction costs.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention pertains. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
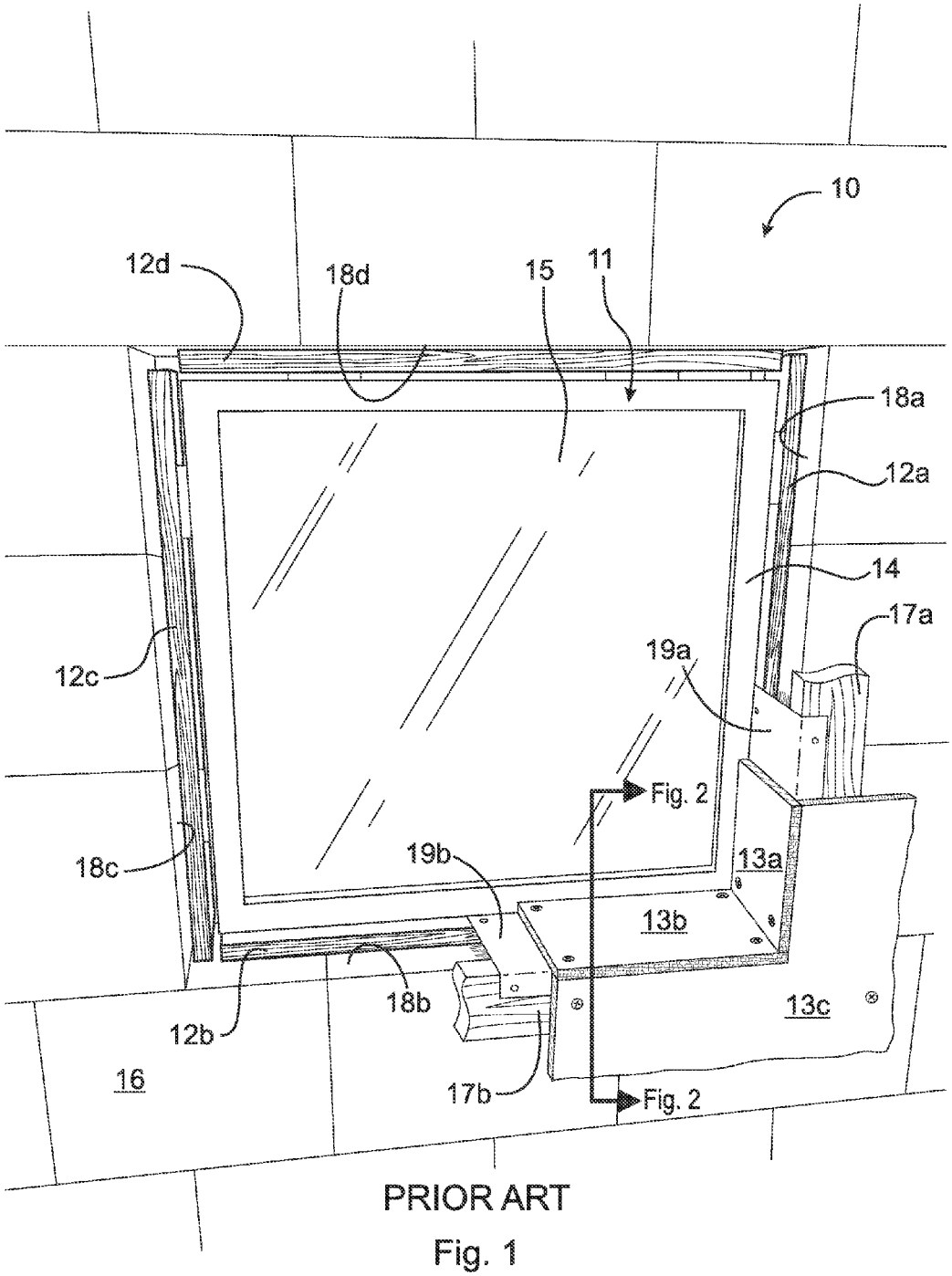
PRIOR ART Fig. 1
FIG. 1 is a front perspective view of a typical prior art window frame/window buck assembly.
Figure 2:
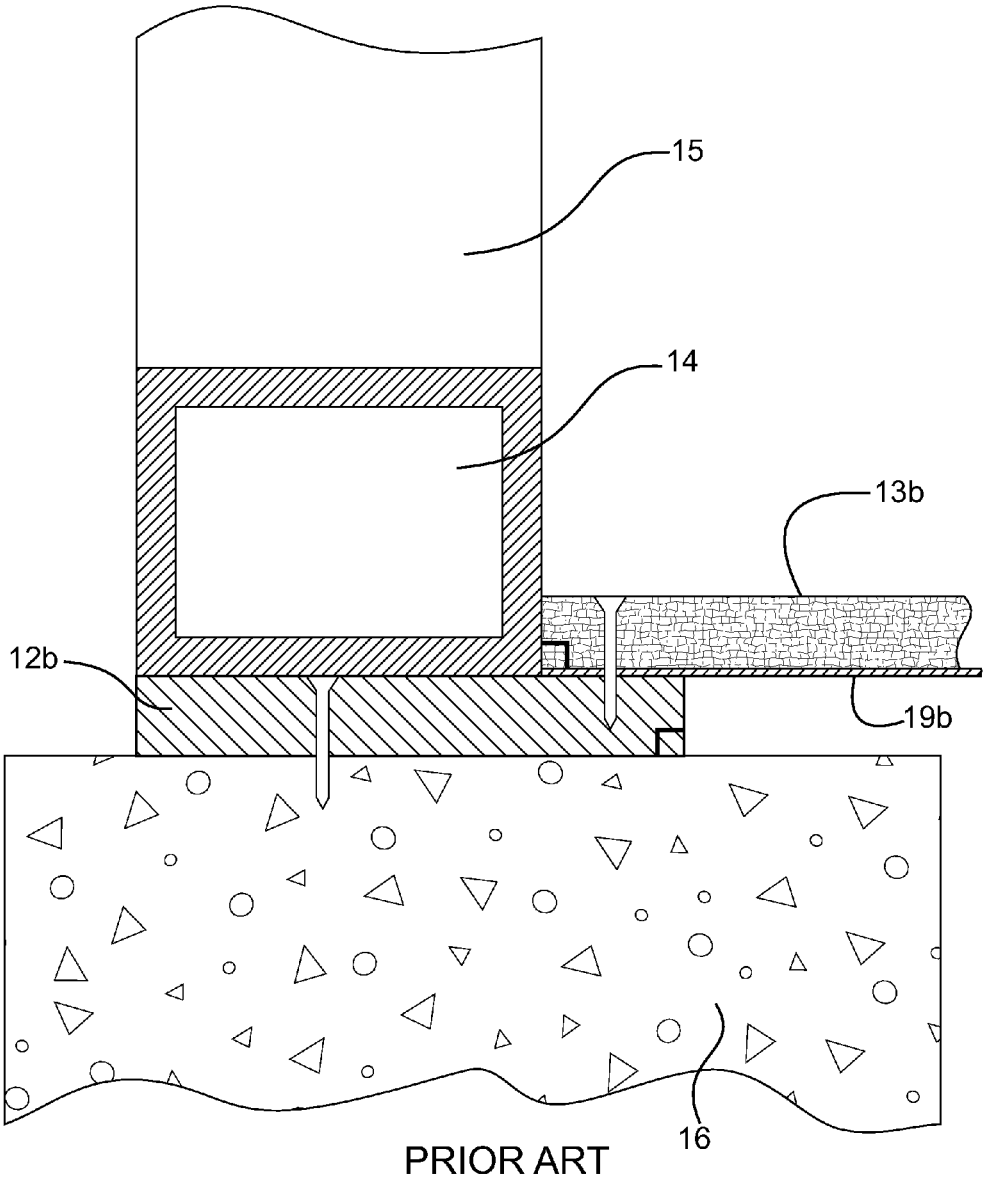
PRIOR ART Fig. 2
FIG. 2 is a cross-sectional view of the prior art window buck/drywall panel assembly taken generally along line 2-2 of FIG. 1.
Figure 3:
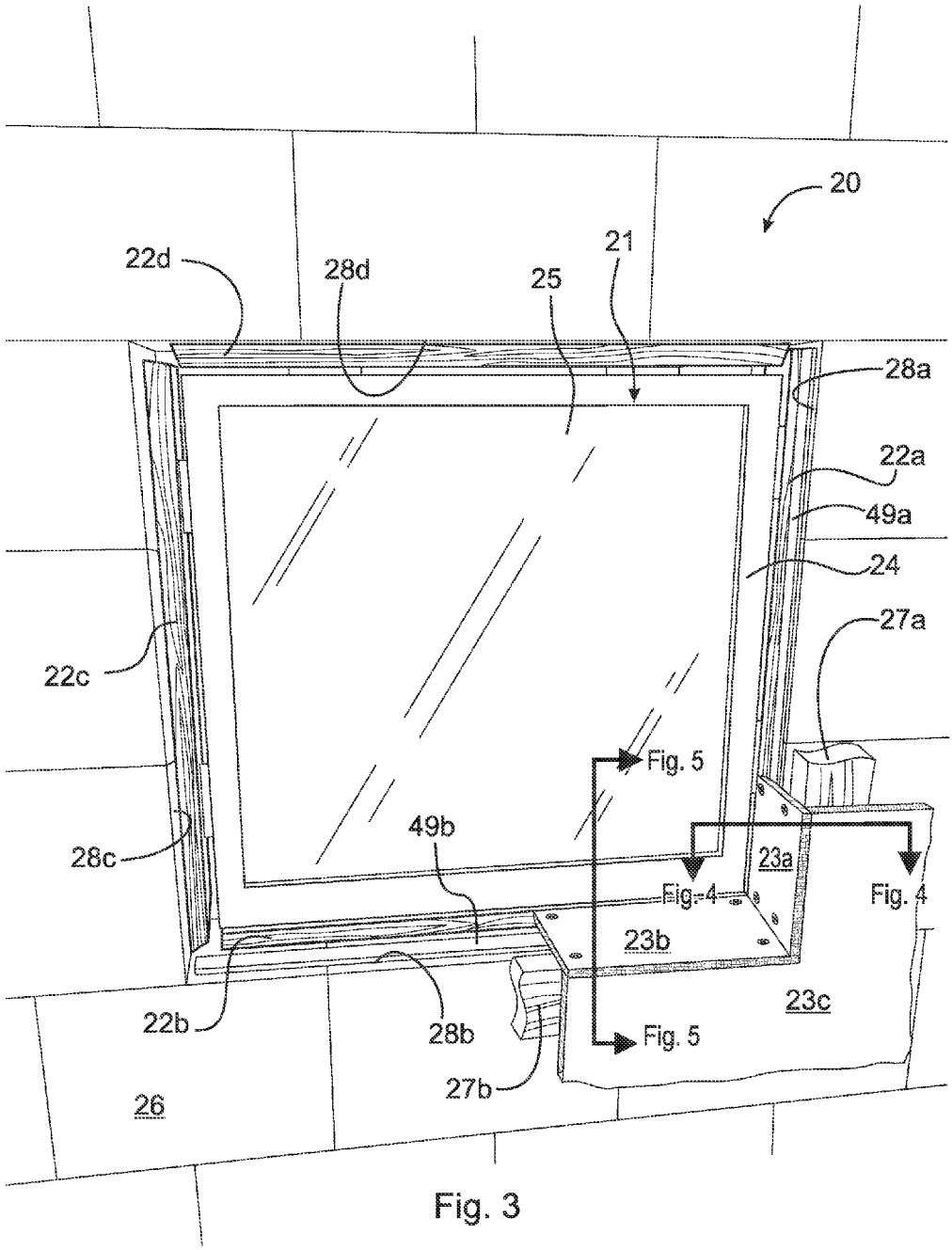
FIG. 3 is a front perspective view of the window frame/window buck assembly of the present invention.

Adverting now to the figures, FIG. 3 illustrates the preferred embodiment of the present invention. FIG. 3 is a front perspective view of the window assembly of the present invention window frame/window buck/drywall panel assembly, hereinafter referred to as window buck assembly 20, shown housed within a window opening. Generally, window buck assembly 20 comprises four window bucks 22*a*, 22*b*, 22*c*, and 22*d*, and drywall panels 23*a*, 23*b*, 23*c* and window assembly 21, having window frame 24 and window 25.

Wall 16 includes four window opening surfaces 28*a*, 28*b*, 28*c*, and 28*d*. Each window buck 22*a*, 22*b*, 22*c*, and 22*d*, is fixedly secured to a corresponding window opening surface 28*a*, 28*b*, 28*c*, and 28*d*, respectively. Specifically, window buck 22*a* is arranged substantially vertically and fixedly secured to window opening surface 28*a*. Window buck 22*a* is disposed substantially perpendicular to window bucks 22*b*, 22*d*. Window buck 22*b* is arranged substantially horizontally and fixedly secured to window opening 28*b*. Window buck 22*b* is disposed substantially perpendicular to window bucks 22*a*, 22*c*. Window buck 22*c* is arranged substantially vertically and fixedly secured to window opening surface 28*c*. Window buck 22*c* is disposed substantially perpendicular to window bucks 22*b*, 22*d*. Window buck 22*d* is arranged substantially horizontally and fixedly secured to window opening surface 28*d*. Window buck 22*d* is disposed substantially perpendicular window bucks 22*a*, 22*c*. Window bucks 22*a*, 22*b*, 22*c*, and 22*d* are fixedly secured to corresponding window opening surfaces 28*a*, 28*b*, 28*c*, and 28*d*, respectively, via concrete screws. Although, it should be appreciated that the window bucks may be secured to the window opening surfaces by any suitable means, such as screws, nails, etc.

Although the window buck assembly includes four (4) window bucks and four (4) window opening surfaces, it should be apparent that window assemblies can vary in size and shape, and therefore, the number of window bucks and window opening surfaces may be fewer or greater depending on the size and shape of the window opening. Additionally, in a preferred embodiment, the window buck is made of a composite material. However, it should be appreciated that the window buck can be made of any suitable material, such as wood, polyvinyl chloride, plastic, etc.

Wood blocks 27*a*, 27*b* are fixedly secured to wall 26 adjacent to the window opening. Wood block 27*a* is fixedly secured vertically to wall 16 and substantially perpendicular to wood block 27*b*, which is secured horizontally to wall 16. In a preferred embodiment, wood blocks 27*a*, 27*b* are secured via concrete screws. However, it should be appreciated that the wood block may be secured by any suitable means, such as screws, nails, etc. It should be appreciated that, in a preferred embodiment, wood blocks 27*a*, 27*b* are made of wood; however, wood blocks 27*a*, 27*b* may be made of any suitable material, such as wood, plastic, composite material, etc. Drywall panel 23*a* is cut on a bias and matingly engages window buck 22*a*, which is cut on the opposite bias. Similarly, drywall panel 23*b* matingly engages window buck 22*b* in substantially the same manner. In a preferred embodiment, drywall panels 23*a*, 23*b* are fixedly secured to window bucks 22*a*, 22*b*, respectively, via drywall screws, but may be secured by any suitable means.

Each drywall panel 23*a*, 23*b* is fixedly secured and substantially perpendicular to a corresponding wood block 27*a*, 27*b*, respectively. In a preferred embodiment, drywall panels 23*a*, 23*b* are fixedly secured to wood blocks 27*a*, 27*b*, respectively, via drywall screws, but may be secured by any suitable means. Preferably, furring strips 49*a*, 49*b* are fixedly secured to corresponding window opening surface 28*a*, 28*b*, respectively, via concrete screws in between window opening surfaces 28*a*, 28*b*, and drywall panels 23*a*, 23*b*, respectively. Drywall panel 23*c* is fixedly secured to wood blocks 27*a*, 27*b* such that drywall panel 23*c* is substantially perpendicular to drywall panels 23*a*, 23*b*. By securing the drywall panels as mentioned above, window frame 24 is completely visible.

Figure 4:
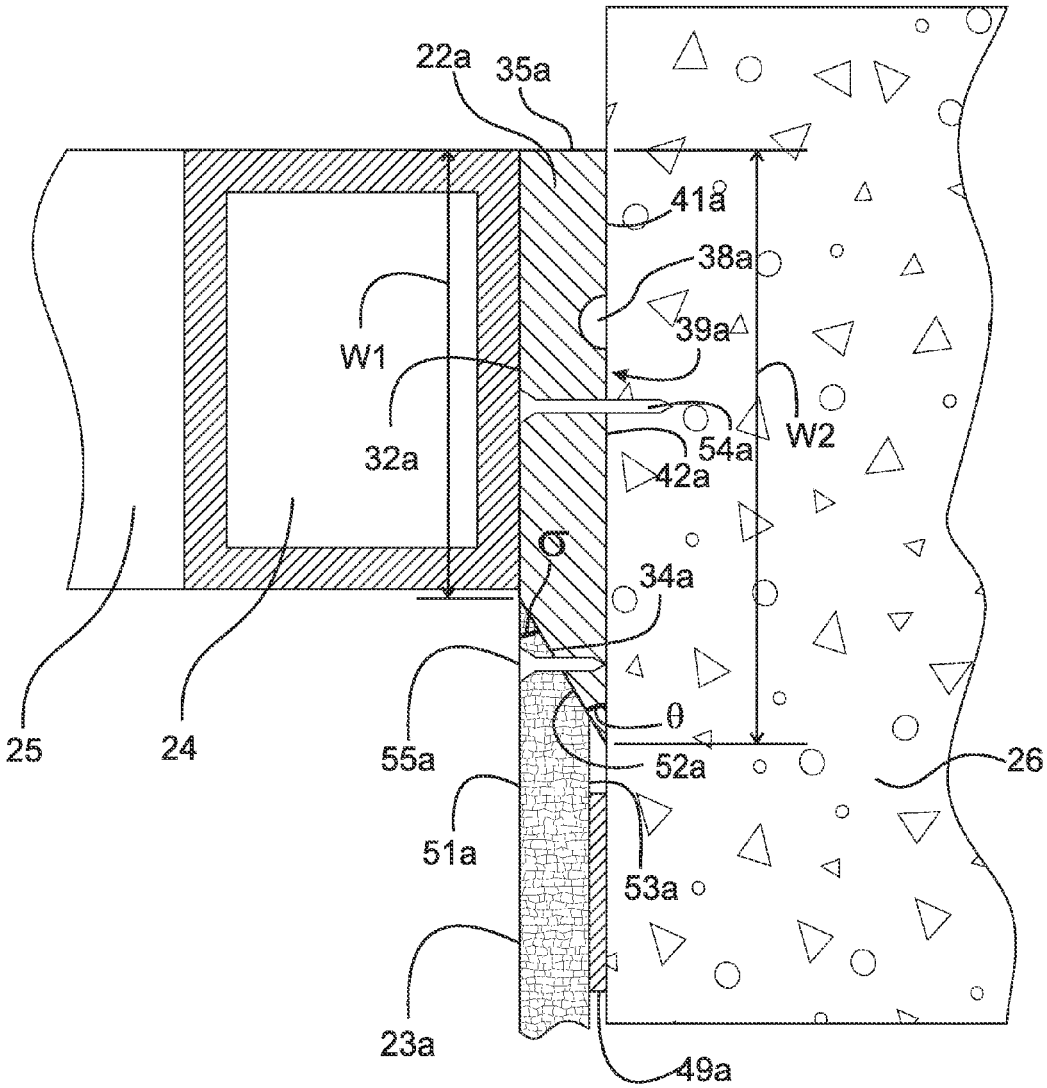
FIG. 4 is a cross-sectional view of the window buck/drywall panel assembly taken generally along line 4-4 of FIG. 3.

FIG. 4 is a cross-sectional view of window buck 22*a* and drywall panel 23*a* taken generally along line 4-4 of FIG. 3. Window buck 22*a* comprises top surface 32*a*, bottom surface 39*a*, first side surface 35*a*, and second side surface 34*a*. Concrete screw 54*a* is bored through top surface 32*a* of window buck 22*a* into wall 26 until the head of the screw is flush with top surface 32*a* in order to fixedly secure window buck 22*a* to window opening surface 28*a*. Drywall panel 23*a* comprises top surface 51*a*, bottom surface 53*a*, first side surface (not shown in FIG. 4) and second side surface 52*a*. Drywall screw 55*a* is bored through top surface 51*a* of drywall panel 23*a* into window buck 22*a* until the head of the screw is flush with top surface 51*a* in order to fixedly secure drywall panel 23*a* to window buck 22*a*. In a preferred embodiment, bottom surface 39*a* comprises first bottom surface 41*a*, second bottom surface 42*a*, and channel 38*a*. Channel 38*a* is recessed with bottom surface 39*a* and runs longitudinally along bottom surface 39*a* creating a division between first bottom surface 41*a* and second bottom surface 42*a*. Channel 38*a* is operatively arranged to receive caulking, or other adhesive material, as an additional means of securing the window buck to the window opening surface. Moreover, the caulking creates a watertight seal between the window buck and the window opening surface. It should be appreciated that the window buck and the drywall panel may be secured by any suitable means and manner.

Figure 5:
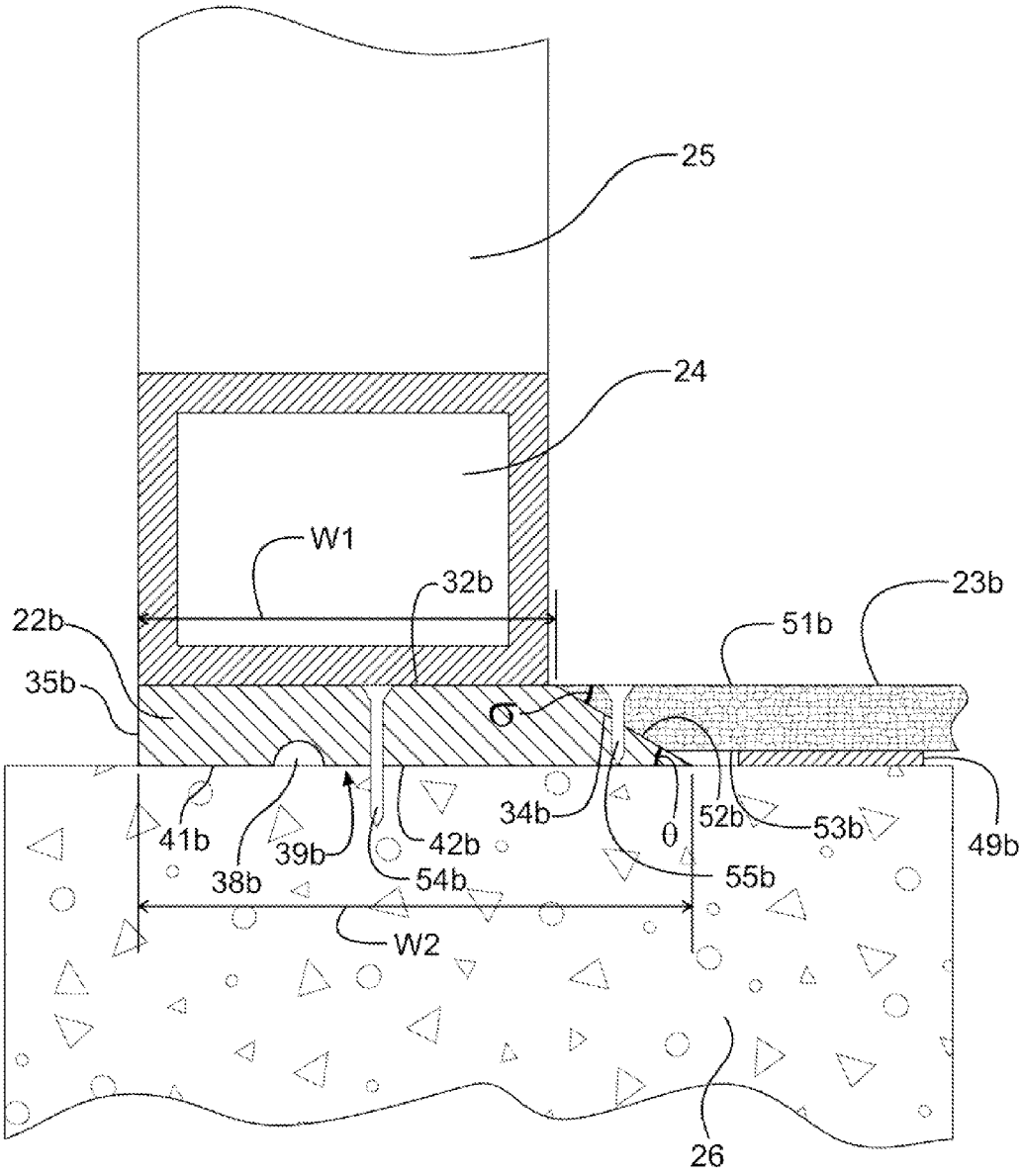
FIG. 5 is a cross-sectional view of the window buck/drywall panel assembly taken generally along line 5-5 of FIG. 3.

FIG. 5 is a cross-sectional view of window buck 22*b* and drywall panel 23*b* taken generally along line 5-5 of FIG. 3. Window buck 22*b* comprises top surface 32*b*, bottom surface 39*b*, first side surface 35*b*, and second side surface 34*b*. Concrete screw 54*b* is bored through top surface 32*b* of window buck 22*b* into wall 26 until the head of the screw is flush with top surface 32*b* in order to fixedly secure window buck 22*b* to window opening surface 28*b*. Drywall panel 23*b* comprises top surface 51*b*, bottom surface 53*b*, first side surface (not shown in FIG. 4) and second side surface 52*b*. Drywall screw 55*b* is bored through top surface 51*b* of drywall panel 23*b* into window buck 22*b* until the head of the screw is flush with top surface 51*b* in order to fixedly secure drywall panel 23*b* to window buck 22*b*. In a preferred embodiment, bottom surface 39*b* comprises first bottom surface 41*b*, second bottom surface 42*b*, and channel 38*b*. Channel 38*b* is recessed with bottom surface 39*b* and runs longitudinally along bottom surface 39*b* creating a division between first bottom surface 41*b* and second bottom surface 42*b*. Channel 38*b* is operatively arranged to receive caulking, or other adhesive material, as an additional means of securing the window buck to the window opening surface. As mentioned previously, the caulking also provides a watertight seal between the window buck and the window opening surface. It should be appreciated that the window buck and the drywall panel may be secured by any suitable means and manner.

As shown in FIGS. 4 and 5, the second side surface and the bottom surface of the window buck are arranged at acute angle θ to one another, forming a beveled edge. The second side surface and the bottom surface of the drywall panel are arranged at acute angle σ to one another, forming a beveled edge. In a preferred embodiment, angle θ and angle σ are identical, such that both angle θ and angle σ are 45 degrees. It should be appreciated, however, that the angles can vary depending on the configuration of the particular window buck/drywall panel assembly. Because both the window buck and the drywall panel are cut on a bias, second side surface 34*a* of window buck 22*a* matingly engages second side surface 52*a* of drywall panel 23*a*, such that entire window frame 24 is revealed. When second side surface 34*a* of window buck 22*a* matingly engages second side surface 52*a* of drywall panel 23*a*, top surface 32*a* of window buck 22*a* and top surface 51*a* of drywall panel 23*a* are flush with one another. Similarly, second side surface 34*b* of window buck 22*b* matingly engages second side surface 52*b* of drywall panel 23*b*, such that entire window frame 24 is revealed. In addition, when second side surface 34*a* of window buck 22*a* matingly engages second side surface 52*a* of drywall panel 23*a*, top surface 32*a* of window buck 22*a* and top surface 51*a* of drywall panel 23*a* are flush with one another.

Top surface 32*a* has top width W1 and bottom surface has a bottom width W2. Bottom surface 39*a* is substantially parallel to top surface 32*a* and top surface 32*a* and bottom surface 39*a* are coplanar. First side surface 35*a* is transverse and substantially perpendicular to top surface 32*a* and bottom surface 39*a*. Second side surface 34*a* is arranged opposite to first side surface 35*a*, such that second side surface 34*a* slopes downwardly from top surface 32*a* to bottom surface 39*a*. Therefore, top width W1 is smaller than bottom width W2.

Figure 6:
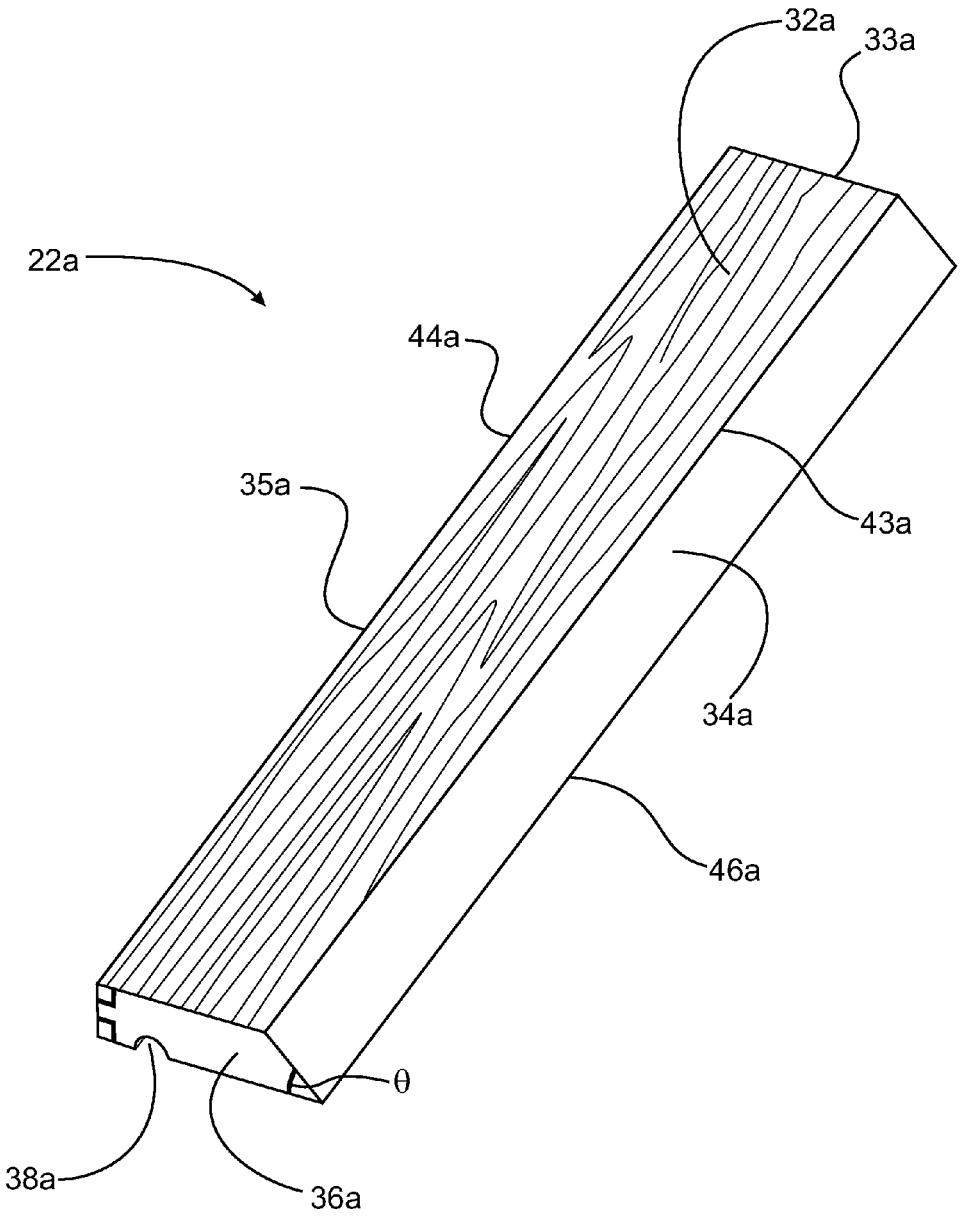
FIG. 6 is a top perspective view of the window buck shown in FIG. 3; and, FIG. 7 is a bottom perspective view of the window buck shown in FIG. 3.
Figure 7:
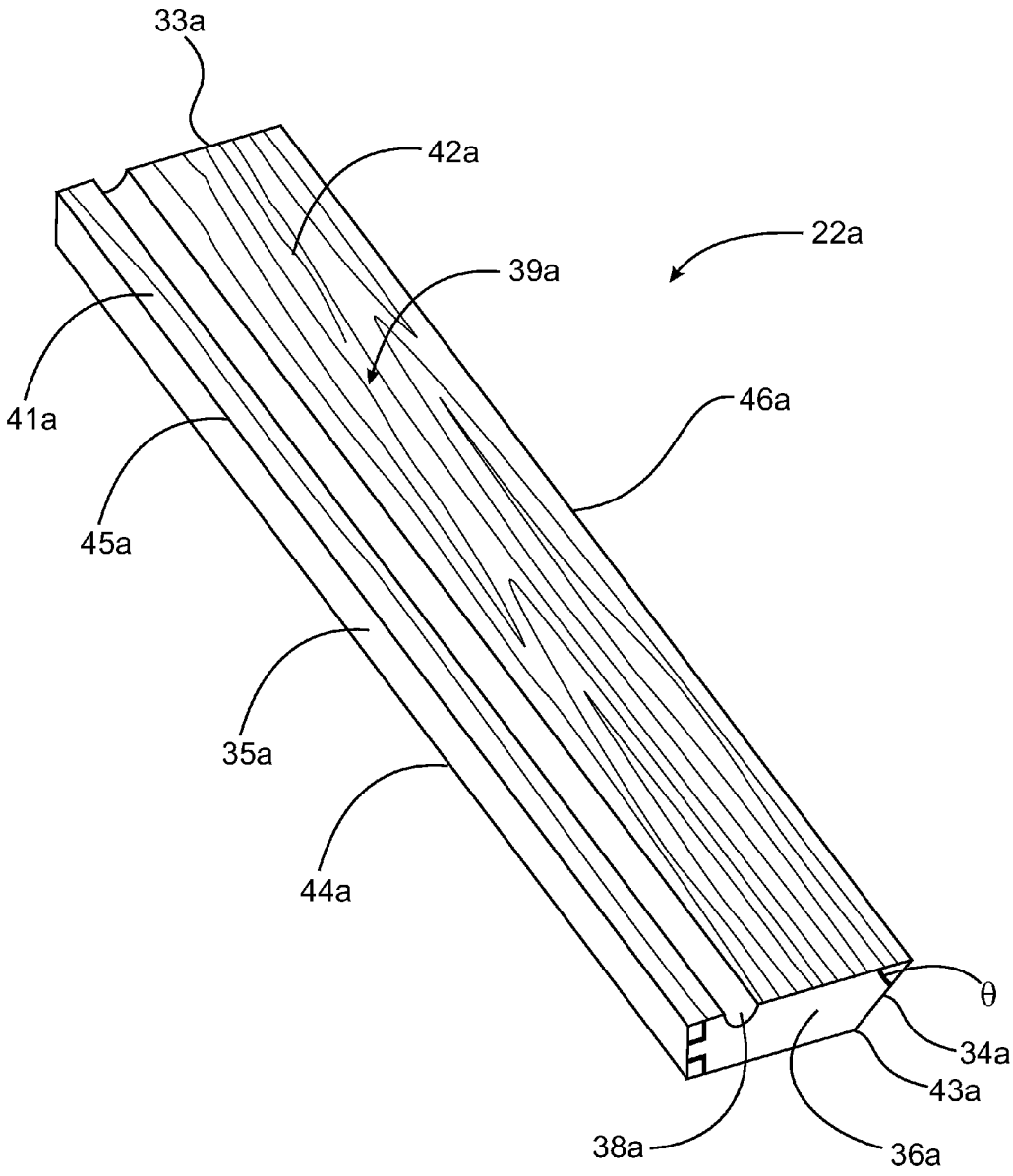

FIGS. 6 and 7 are perspective views of window buck 22*a* shown in FIG. 3. Window buck 22*a* comprises edges 43*a*, 44*a*, 45*a*, and 46*a*. Edge 43*a* is formed by the intersection of top surface 32*a* and second side surface 34*a*. Edge 44*a* is formed by the intersection of top surface 32*a* and first side surface 35*a*. Edge 45*a* is formed by the intersection of bottom surface 39*a* and first side surface 35*a*. Edge 46*a* is formed by the intersection of bottom surface 39*a* to second side surface 34*a*. Regardless of the orientation of window buck 22*a* in window buck assembly 20, the length of window buck 22*a* is understood as the distance between first end surface 36*a* and second end surface 33*a*, and the height of window buck 22*a* is understood as the distance between edges 44*a* and 45*a*. The length and height of window bucks 22*b*, 22*c*, and 22*d* are understood by their analogous end surfaces and edges regardless of their orientation in window buck assembly 20. For example, FIG. 4 is a cross-sectional view of window buck 22*a* in a width-height coordinate plane of window buck 22*a*, and FIG. 5 is a cross-sectional view of window buck 22*b* in a width-height coordinate plane of window buck 22*b*.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A window buck comprising:

a first surface having a first front edge, a first back edge, and a first width between said first front edge and said first back edge, a first side edge, a second side edge, and a first length between said first side edge and said second side edge;

a second surface having a second front edge, a second back edge, and a second width between said second front edge and said second back edge, a third side edge, a fourth side edge, and a second length between said third side edge and said fourth side edge, said second surface arranged parallel to said first surface;

a rear surface having an inner edge, an outer edge, and a height between said inner edge and said outer edge, a fifth side edge, a sixth side edge, and a third length between said fifth side edge and said sixth side edge, the rear surface perpendicular to said first and second surfaces with said outer edge connected to said first back edge and said inner edge connected to said second back edge;

a beveled surface connected to said first and second front edges such that said first width is greater than said second width, said beveled surface having a seventh side edge, an eighth side edge, and a fourth length between said seventh side edge and said eight side edge;

a first end surface connected to said first, third, fifth, and seventh side edges;

a second end surface connected to said second, fourth, sixth, and eighth side edges;

a cross-section defining a right trapezoid in a width-height coordinate plane dimensioned by the widths and the height;

wherein said window buck has a longitudinal axis and said beveled surface slopes downwardly substantially perpendicularly with respect to said longitudinal axis;

wherein said window buck is secured to a window opening having a window opening surface, said window opening surface having a window opening surface outer edge, a window opening surface inner edge, a window opening surface width between said window opening surface outer edge and said window opening outer inner edge, a first window opening surface edge, a second window opening surface edge, and a window opening surface length, such that said first surface of said window buck abuts said window opening surface with the beveled surface proximate the window opening surface outer edge.

2. The window buck recited in claim 1, wherein said beveled surface arranged at an acute angle θ to said first surface in the range of approximately 30 degrees to approximately 60 degrees.

3. The window buck recited in claim 2, wherein said acute angle θ is approximately 45 degrees.

4. The window buck recited in claim 2, wherein said window buck is made of polyvinyl chloride.

5. The window buck recited in claim 2, wherein said window buck is made of plastic.

6. The window buck recited in claim 2, wherein said window buck is made of wood.

7. The window buck recited in claim 2, wherein said window buck is made of a composite material.

8. The window buck recited in claim 2, wherein said second surface comprises a channel operatively arranged to receive caulking.

9. The window buck recited in claim 2, wherein said window buck is operatively arranged to be securable to said window opening via screws.

10. The window buck recited in claim 2, wherein said window buck is operatively arranged to be securable to said window opening via nails.

11. A drywall panel for a window assembly having a window buck and a window frame housed within a window opening, the window opening having a window opening surface, said window opening surface having a window opening surface outer edge, a window opening surface inner edge, a window opening surface width between said window opening surface outer edge and said window opening outer inner edge, a first window opening surface edge, a second window opening surface edge, and a window opening surface length, the drywall panel comprising:

a first surface having a first front edge, a first back edge, and a first width between said first front edge and said first back edge, a first side edge, a second side edge, and a first length between said first side edge and said second side edge;

a second surface having a second front edge, a second back edge, and a second width between said second front edge and said second back edge, a third side edge, a fourth side edge, and a second length between said third side edge and said fourth side edge, said second surface arranged parallel to said first surface;

a front surface having an inner edge, an outer edge, and a height between said inner and said outer edge, a fifth side edge, a sixth side edge, and a third length between said fifth side edge and said sixth side edge, the front surface perpendicular to said first and second surfaces with said outer edge connected to said first front edge and said inner edge connected to said second front edge;

a beveled surface connected to said first and second back edges such that said first width is greater than said second width, said beveled surface having a seventh side edge, an eighth side edge, and a fourth length between said seventh side edge and said eight side edge;

a first end surface connected to said first, third, fifth, and seventh side edges;

a second end surface connected to said second, fourth, sixth, and eighth side edges; and, a cross-section defining a right trapezoid in a width-height coordinate plane dimensioned by the widths and the height;

wherein said drywall panel has a longitudinal axis and said beveled surface slopes downwardly substantially perpendicularly with respect to said longitudinal axis;

wherein said drywall panel is fixedly secured to the window buck such that said first width adds to the window opening surface width.

12. The drywall panel recited in claim 11, wherein said beveled surface is arranged at an acute angle σ to said first surface in the range of approximately 30 degrees to approximately 60 degrees.

13. The drywall panel recited in claim 12, wherein said acute angle σ is approximately 45 degrees.

14. A window buck/drywall panel assembly comprising:

a window buck having:

a first buck surface having a first buck front edge, a first buck back edge, and a first buck width between said first buck front edge and said first buck back edge, a first side buck edge, a second side buck edge, and a first buck length between said first side buck edge and said second side buck edge;

a second buck surface having a second buck front edge, a second buck back edge, and a second buck width between said second buck front edge and said second buck back edge, a third side buck edge, a fourth side buck edge, and a second buck length between said third side buck edge and said fourth side buck edge, said second buck surface arranged parallel to said first buck surface;

a rear buck surface having an inner buck edge, an outer buck edge, and a buck height between said inner buck edge and said outer buck edge, a fifth side buck edge, a sixth side buck edge, and a third buck length between said fifth side buck edge and said sixth side buck edge, the rear buck surface perpendicular to said first and second buck surfaces with said buck outer edge connected to said first buck back edge and said inner buck edge connected to said second back edge;

a beveled buck surface connected to said first and second buck front edges such that said first buck width is greater than said second buck width, said first beveled buck surface having a seventh side buck edge, an eighth side buck edge, and a fourth buck length between said seventh side buck edge and said eighth side buck edge;

a first end buck surface connected to said first, third, fifth, and seventh side buck edges;

a second end buck surface connected to said second, fourth, sixth, and eighth side buck edges; and, a buck cross-section defining a right trapezoid in a buck width-height coordinate plane dimensioned by the buck widths and the buck height;

wherein said window buck has a longitudinal axis and said beveled buck surface slopes downwardly substantially perpendicularly with respect to said longitudinal axis;

wherein said window buck is secured to a window opening having a window opening surface, said window opening surface having a window opening surface outer edge, a window opening surface inner edge, a window opening surface width between said window opening surface outer edge and said window opening inner edge, a first window opening surface edge, a second window opening surface edge, and a window opening surface length, such that said first buck surface of said window buck abuts said window opening surface with the first beveled surface proximate the window opening surface outer edge; and, a drywall panel having:

a first panel surface having a first panel front edge, a first panel back edge, and a first panel width between said first panel front edge and said first panel back edge, a first side panel edge, a second side panel edge, and a first panel length between said first side panel edge and said second side panel edge;

a second panel surface having a second panel front edge, a second panel back edge, and a second panel width between said second panel front edge and said second panel back edge, a third side panel edge, a fourth side panel edge, and a second panel length between said third side panel edge and said fourth side panel edge, said second panel surface arranged parallel to said first panel surface;

a front panel surface having an inner panel edge, an outer panel edge, and a panel height between said inner and said outer panel edges, a fifth side panel edge, a sixth side panel edge, and a third panel length between said fifth side panel edge and said sixth side panel edge, the front panel surface perpendicular to said first and second panel surfaces with said outer panel edge connected to said first front panel edge and said inner panel edge connected to said second front panel edge;

a beveled panel surface connected to said first and second panel back edges such that said first panel width is greater than said second panel width, said beveled panel surface having a seventh side panel edge, an eighth side panel edge, and a fourth panel length between said seventh side panel edge and said eighth side panel edge;

a first end panel surface connected to said first, third, fifth, and seventh side panel edges;

a second end panel surface connected to said second, fourth, sixth, and eighth side panel edges; and, a panel cross-section defining a right trapezoid in a panel width-height coordinate plane dimensioned by the panel widths and the panel height;

wherein said drywall panel has a longitudinal axis and said beveled panel surface slopes downwardly substantially perpendicularly with respect to said longitudinal axis wherein said drywall panel is fixedly secured to a window buck such that said drywall panel does not obscure said window frame;

wherein said window buck and said drywall panel are fixedly secured to one another such that said beveled buck surface and said beveled panel surface are in contact with one another.

15. The window buck/drywall panel assembly recited in claim 14, wherein said first beveled surface and said second buck surface are arranged at an acute angle θ to one another; and, said beveled panel surface and said second panel surface are arranged at an acute angle σ to one another;

wherein said acute angle θ is in the range of approximately 30 degrees to approximately 60 degrees, and said acute angle σ is in the range of approximately 30 degrees to approximately 60 degrees.

16. The window buck/drywall panel assembly recited in claim 15, wherein both said acute angle θ and said acute angle σ are approximately 45 degrees.

17. A method of installing a window in an opening in a dwelling, where said window includes a frame and an outside surface, and said opening is bounded by concrete or cinder blocks, said method comprising the following steps:

providing a window buck having:

a first buck surface having a first buck front edge, a first buck back edge, and a first buck width between said first buck front edge and said first buck back edge;

a second buck surface having a second buck front edge, a second buck back edge, and a second buck width between said second buck front edge and said second buck back edge, said second buck surface arranged parallel to said first buck surface;

a rear buck surface having an inner buck edge, an outer buck edge, and a buck height between said inner buck edge and said outer buck edge, the rear buck surface perpendicular to said first and second buck surfaces with said buck outer edge connected to said first buck back edge and said inner buck edge connected to said second back edge;

a first beveled surface connected to said first and second buck front edges such that said first buck width is greater than said second buck width; and, a buck cross-section defining a right trapezoid in a width-height coordinate plane dimensioned by the buck widths and the buck height;

securing said window buck to said concrete or cinder blocks bounding said opening at said first buck surface;

securing said window frame outside surface to said window buck at said second buck surface; and, providing a drywall panel having:

a first panel surface having a first panel front edge, a first panel back edge, and a first panel width between said first panel front edge and said first panel back edge;

a second panel surface having a second panel front edge, a second panel back edge, and a second panel width between said second panel front edge and said second panel back edge, said second panel surface arranged parallel to said first panel surface;

a front panel surface having an inner panel edge, an outer panel edge, and a panel height between said inner and said outer panel edges, the front panel surface perpendicular to said first and second panel surfaces with said outer panel edge connected to said first front panel edge and said inner panel edge connected to said second front panel edge;

a beveled panel surface connected to said first and second panel back edges such that said first panel width is greater than said second panel width; and, a panel cross-section defining a right trapezoid in a width-height coordinate plane dimensioned by the panel widths and the panel height;

wherein said drywall panel is operatively arranged to be fixedly secured to a window buck such that said drywall panel does not obscure said window frame;

securing said drywall panel to said window buck such that said window buck beveled edge and said drywall beveled edge are in contact with one another.

18. A window frame/window buck assembly for a window opening, the window opening having window opening surfaces, each of said window opening surfaces having a window opening surface outer edge, a window opening surface inner edge, a window opening surface width between said window opening surface outer edge and said window opening inner edge, a first window opening surface end, and a second window opening surface end, wherein each window opening surface first end is connected to another window opening surface second end, the window frame/window buck assembly comprising:

a window assembly having a frame, said frame having four frame panels, each frame panel having a first end surface and a second end surface, a frame panel outer surface, a frame panel inner surface, a frame panel width between said frame panel outer surface and said frame panel inner surface, and a frame base surface parallel to a frame free surface, wherein each frame panel first end is connected to another frame panel second end; and, a window buck assembly having four window bucks, each window buck having:

a first buck surface having a first buck front edge, a first buck back edge, and a first buck width between said first buck front edge and said first buck back edge, a first side buck edge, a second side buck edge, and a first buck length between said first side buck edge and said second side buck edge;

a second buck surface having a second buck front edge, a second buck back edge, and a second buck width between said second buck front edge and said second buck back edge, a third side buck edge, a fourth side buck edge, and a second buck length between said third side buck edge and said fourth side buck edge, said second buck surface arranged parallel to said first buck surface;

a rear buck surface having an inner buck edge, an outer buck edge, and a buck height between said inner buck edge and said outer buck edge, a fifth side buck edge, a sixth side buck edge, and a third buck length between said fifth side buck edge and said sixth side buck edge, the rear buck surface perpendicular to said first and second buck surfaces with said buck outer edge connected to said first buck back edge and said inner buck edge connected to said second back edge;

a beveled buck surface connected to said first and second buck front edges such that said first buck width is greater than said second buck width, said first beveled buck surface having a seventh side buck edge, an eighth side buck edge, and a fourth buck length between said seventh side buck edge and said eighth side buck edge;

a first end buck surface connected to said first, third, fifth, and seventh side buck edges;

a second end buck surface connected to said second, fourth, sixth, and eighth side buck edges; and, a cross-section, where said cross-section consists of a right trapezoid in a width-height coordinate plane, wherein each of said window frame base surfaces are secured to one of said window bucks at said second surface such that a drywall panel will not obscure the frame if attached to the window buck beveled surface.

19. A window frame/window buck/drywall panel assembly, comprising:

a window assembly having a frame, said frame having four outer surfaces;

a window buck assembly to circumscribe said frame having four window bucks, each window buck having a height and a cross-section and each window buck includes a window buck beveled edge, where said cross-section defines a right trapezoid having a first surface of a first width greater than a second width of a second surface in a width-height coordinate plane, where each of said outer surfaces of said window frame is secured to one of said window bucks at said second surface; and, a drywall panel assembly having four drywall panels, each said drywall panel having a height and a cross-section, where said cross-section defines a right trapezoid having a third surface of a third width greater than a fourth width of a fourth surface in the width-height coordinate plane and wherein said drywall panel includes a drywall beveled edge, where said drywall panel assembly is fixedly secured to said window buck assembly such that a window buck beveled edge of each window buck is in contact with a drywall beveled edge of each drywall panel and said second and third surfaces sit flush with each other.

* * * * *